United States Patent [19]

Barber, Jr.

[11] Patent Number: 5,040,255

[45] Date of Patent: Aug. 20, 1991

[54] CUSHION OR MATTRESS STRUCTURE

[75] Inventor: John W. Barber, Jr., Anderson, Ind.

[73] Assignee: Barber Manufacturing Company, Inc., Anderson, Ind.

[21] Appl. No.: 534,120

[22] Filed: Jun. 6, 1990

[51] Int. Cl.[5] ..... A47C 27/05

[52] U.S. Cl. ..... 5/477; 5/475

[58] Field of Search ..... 5/477, 478, 475, 476, 5/479, 480, 481

[56] References Cited

U.S. PATENT DOCUMENTS

| | | | |
|---|---|---|---|
| 1,025,489 | 5/1912 | Thompson . | |
| 1,246,081 | 11/1917 | Genge . | |
| 1,466,617 | 8/1923 | Foster . | |
| 1,703,587 | 2/1929 | Kraft | 5/477 |
| 2,862,214 | 12/1958 | Thompson et al. . | |
| 3,462,779 | 8/1969 | Thompson | 5/477 |
| 3,869,739 | 3/1975 | Klein . | |
| 4,186,223 | 1/1980 | Hancock | 5/247 |
| 4,234,983 | 11/1980 | Stumpf | 5/477 |
| 4,429,427 | 2/1984 | Sklar | 5/474 |
| 4,578,834 | 4/1986 | Stumpf | 5/477 |
| 4,854,023 | 8/1989 | Stumpf | 5/477 |
| 4,868,941 | 9/1989 | Tai | 5/477 |

FOREIGN PATENT DOCUMENTS

| | | | |
|---|---|---|---|
| 1457658 | 9/1966 | France | 5/477 |

*Primary Examiner*—Alexander Grosz

*Attorney, Agent, or Firm*—Woodard, Emhardt, Naughton, Moriarty & McNett

[57] ABSTRACT

An improved cushion or mattress assembly is disclosed including side boxing sections which are glued to top and bottom sections thereby defining a cavity. Prior to glueing the top cover to the assembly, an insulation layer is inserted into the cavity defined therein and glue is applied to the top side of the insulation piece. A string of encased springs is then placed on top of the insulation piece. A second insulation piece with glue applied to the underside is placed on top of the encased spring array in the cavity. The top cover then is glued on the cushion assembly. The entire cushion assembly may be fiber or down covered and encased in a fabric, plastic, leather, or vinyl outer covering. The springs contained within the spring encasement assembly include an hourglass or dual radius contour and are heat treated or mormalized to provide improved stiffness and prolonged life. In addition, the ends of the springs are turned inward and toward the opposite end of the spring to minimize snagging of the spring ends on materials likely to contact the spring within the cushion.

8 Claims, 3 Drawing Sheets

CUSHION OR MATTRESS STRUCTURE

BACKGROUND OF THE INVENTION

This invention relates generally to cushion or mattress structures and more specifically to spring-foam cushions.

An improved foam cushion or mattress combining the advantages of pocketed or encased springs in conjunction with improved durability and "feel" of the cushion is a never ending pursuit of manufacturers of such products. Design aspects of the cushion contribute to a more functionally desirable cushion, as well as minimizing manufacturing costs and improving long-term durability of the cushion.

SUMMARY OF THE INVENTION

A cushion or mattress construction, according to one embodiment of the present invention, comprises a boxing structure having a bottom wall, top wall, and side walls defining a completely enclosed cavity wherein the walls are formed of foam material. The walls are permanently joined by an adhesive. A plurality of unknotted heat treated coil springs are provided wherein each spring has a profile with the top and bottom coils of the spring being larger in diameter than the remaining coils of the spring. A pliable casing material which is folded over upon itself has pockets each of which receives one of the springs. The casing material holds the springs in a predetermined partially compressed condition. The casing includes pairs of vertical seams defining a cutting strip between each adjacent pockets. There is also provided a seam on a bottom side of the casing for sealing and retaining the springs within the casing to form a spring casing assembly when the springs are inserted therein, wherein the spring casing assembly is situated in serpentine fashion and joined by an adhesive to the interior of the cavity thereby filling the cavity with an array of springs defined by the serpentine positioning to the casing containing the springs. The mattress further includes a containment cover shaped to conform to the boxing structure and adapted to receive and entirely enclose the same.

One object of the present invention is to provide an improved cushion or mattress.

Another object of the present invention is to extend the expected life span of a spring-foam cushion.

Related objects and advantages of the present invention will become more apparent from the following description of the preferred embodiment.

DESCRIPTION OF THE PREFERRED EMBODIMENT

Figure 1:
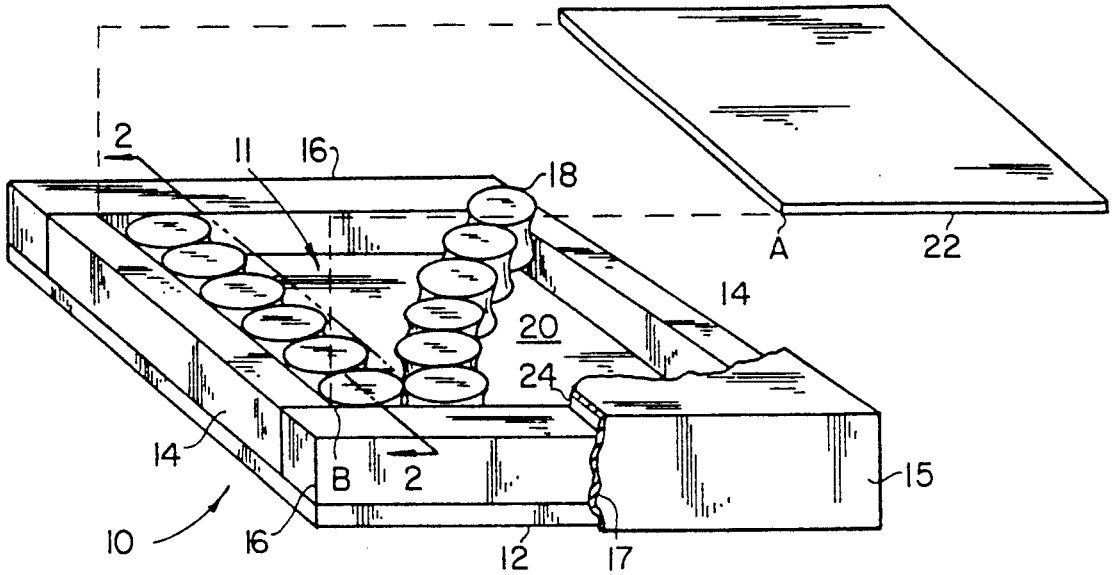
FIG. 1 is a cutaway exploded view of a spring-foam cushion structure according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alternations and further modifications in the illustrated device, and such further applications of the principles of the invention as illustrated therein being contemplated as would normally occur to one skilled in the art to which the invention relates.

Referring now to FIG. 1, the components of the improved spring-foam cushion 10 according to the present invention are shown. A box-like structure is formed by gluing side boxing sections 14 to side boxing sections 16, using adhesive, to produce a rectangular frame or box section. Bottom panel 12 is glued to the underside of the frame comprised of the side boxing sections 14 and 16. Once the bottom wall 12 is glued in place, a cavity 11 is defined in which an insulating foam piece 20 is inserted. Insulation piece 20 is 0.25 inches thick and is cut or formed to coincide with the size of the cavity 11. Glue or an adhesive is applied to the top side of insulation piece 20, and a string of encased springs (hereinafter referred to as encased spring assembly 18), is packed into the cavity opening such that the tops and bottoms of the springs contained within the encasement 18 are situated very near to each other with the axis of each spring positioned vertically thereby defining a two dimensional array of encased springs. After the cavity is filled entirely with the encased spring assembly 18, additional or extra spring casing is sheared or cut away from the string. Next, top insulation piece 22 (which is identical in dimensions with piece 20) is coated on the underside with glue or adhesive. In the next assembly step, insulation piece 22 is laid or placed on top of the encased spring assembly 18 previously disposed in a serpentine fashion or pattern within the cavity 11. When assembled, the insulation piece 22 is situated such that the corner A of the insulation piece is situated at B. Next, the upper surfaces of the boxing sections 14 and 16 are covered with glue or adhesive, and the top cover 24 of the cushion 13 is placed on top of the boxing sections 14 and 16. Finally, a covering 15 formed as a six sided rectangular container completely covers the spring and foam cushion assembly previously constructed. The covering 15 may be provided at the time of manufacture of the cushion or it may be added later by a furniture manufacturer who does not manufacture the cushion.

It should be noted that each spring 30 is received within a respective pocket 40. Further, each of the pockets of the casing compresses its respective spring to a predetermined height so that the springs in the cushion of the final assembly are under a compressed condition in the cushion whether or not someone is sitting on the cushion.

The following portions of the cushion shown in FIG. 1 are made of poly-foam or other suitable foam type cushion material: boxing sections 14 and 16, top cover 24, bottom cover 12, and insulation pieces 20 and 24. The casing used to make the encased spring assembly 18 is made of synthetic fabric-type material which is thermally weldable to itself. The springs contained therein are made of iron-carbon alloys or other steel alloys. The entire foam assembly comprised of boxing sections 14 and 16, and top and bottom covers 12 and 24 may be encased in or wrapped in fiber or down 17 as desired prior to encasement in fabric, leather or suitable substitute material 15 which surrounds the internal cushion assembly. Thus, the cushion can be given an even softer feel by the use of such fiber or down additives 17 interposed between the exterior cover 15 and the internal foam components 12,24,14, and 16.

Figure 2:
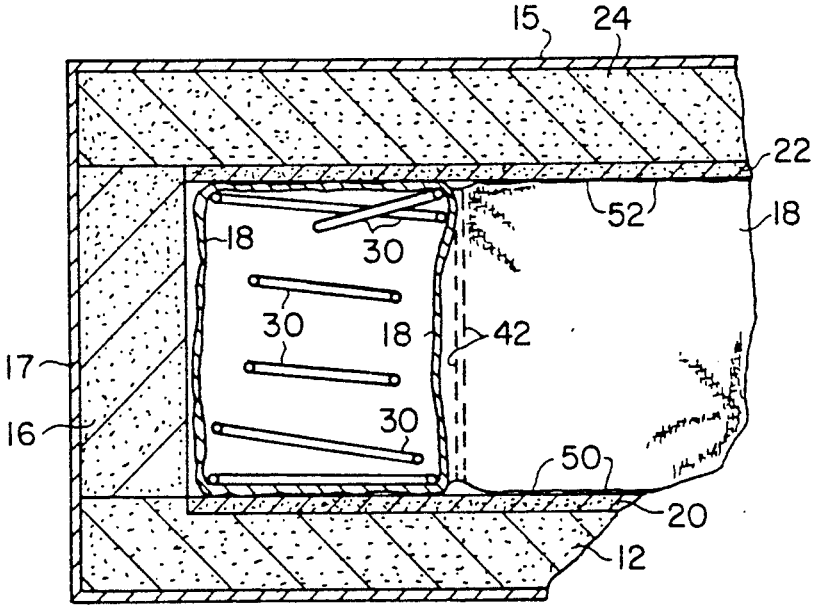
FIG. 2 is a cross-sectional view looking in the direction of the arrows labeled 2—2 in FIG. 1.

Referring now to FIG. 2, a cutaway view looking in the direction of the arrows labeled 2 in FIG. 1 of the cushion 10 according to the present invention is shown. Fiber or down wrapping 17 is located between the cover material 15 and foam section 16, foam covers 12 and 24. Encased spring assembly 18 includes two thermal weld lines 42 which define pockets wherein spings 30 are contained. The thermal weld lines 42 may be severed therebetween in order to separate extra or additional spring pockets from the encased spring assembly 18 when assembling the cushion. Two vertical seams 42, side by side, enable the assembler to cut the assembly 18 between the seams 42 without allowing the springs contained therein to escape. Glue or adhesive is applied at location 50 and 52, on the bottom surface of insulator 22 and the top surface of insulator 20 to maintain the relative position of springs 30 and assembly 18. The coils of spring 30 are smaller in diameter towards the middle of the spring and largest in diameter at the top and bottom of the spring as shown.

Figure 3A:
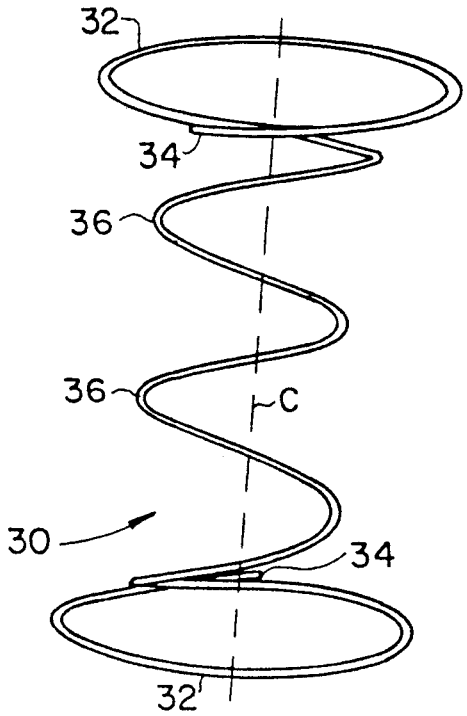
FIG. 3A is a perspective view of a spring according to the present invention.
Figure 3B:
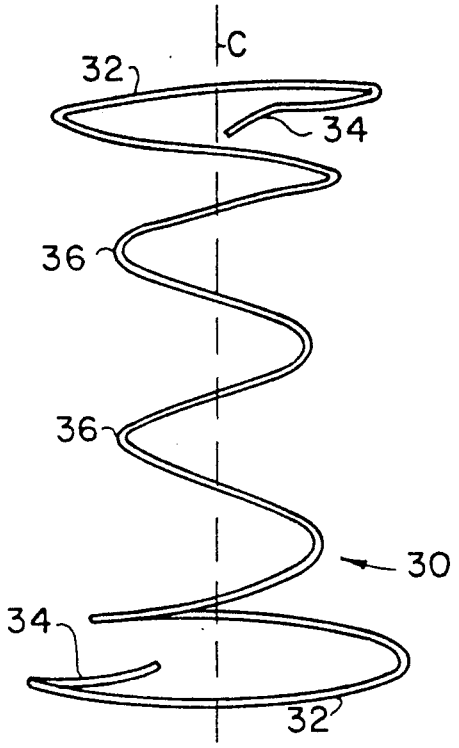
FIG. 3B is a side elevation of the spring of FIG. 3A.
Figure 3C:
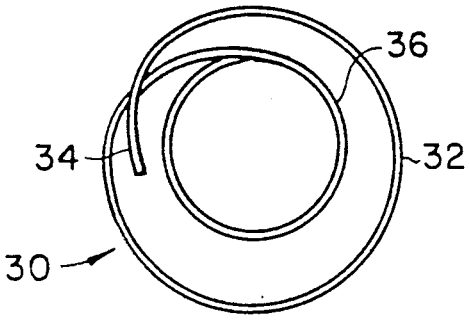
FIG. 3C is a end elevation of the spring of FIGS. 3A and 3B.

Referring now to FIG. 3A, FIG. 3B, and FIG. 3C, a perspective view, a front elevational view, and an end elevation view of a spring 30 are shown. The spring includes coils 32 at the top and bottom which are larger in diameter than the coils located therebetween at 36. In addition, the ends 34 of the spring 30 angled towards the spring axis C and bent towards the opposing end 34 of the spring 30 in oder to prevent the springs from snagging on the material as the springs are placed within and rotated within the pockets of thermal casing material used to make the spring casing assembly 18.

Spring 30 is formed and subsequently normalized or heat treated at a temperature between 500° and 600° F. in order to provide increased spring force as well as extended longevity of the action of the spring. The profile of the spring resembles an hourglass or that which is shown i.e. two radii: a spring end radius associated with 32 and an inner coil radius associated with coils 36. Typically, 16 gauge wire is used for a stiffer response to the spring. The primary objective of the spring profiles as described above is to control the compression force exerted by the spring. The spring may be made to have a greater compression force by making the central coil diamter (at 36) smaller and a lesser force by a larger central diameter of coil at 36. A further objective is to prevent the middle coils of the spring from rubbing against coils of adjacent springs and producing an audible clicking response, and additionally to ensure positive location of the top and bottom coils of the springs in close proximity with adjacent springs in the cavity 11 of FIG. 1.

Figure 4:
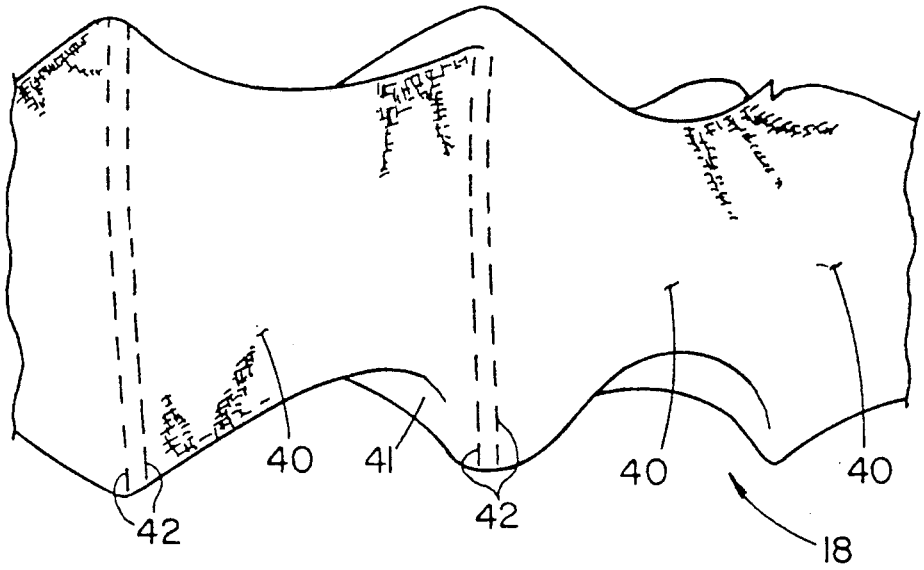
FIG. 4 is a front elevational view of the encased spring assembly 18 of FIG. 1.

Referring now to FIG. 4, a more detailed description of the encased spring assembly 18 is shown. Each pocket area 40 contains a spring 30 as shown in FIG. 3. Dual thermal welds 42 separate each pocket area 40 so that the encased spring assembly may be separated between any spring pocket without allowing the spring 30 contained therein to escape. Separation of the assembly 18 is accomplished by cutting or severing the casing between adjacent and near thermal welds 42. The material used for the casing 41 is typically a synthetic material which is thermally weldable to itself. Alternatively muslin or burlap may be used and sewn to itself.

Figure 5:
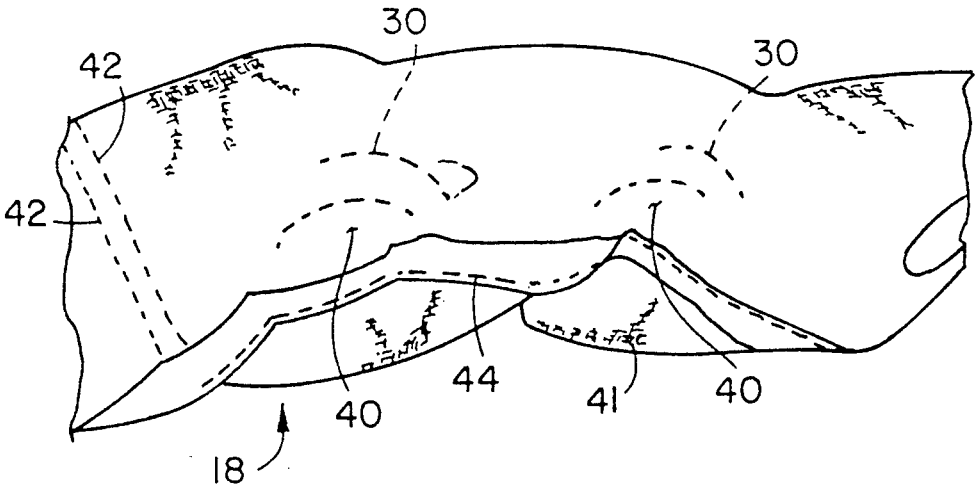
FIG. 5 is a bottom elevational view of the encased spring assembly 18 of FIG. 4.

Refer now to FIG. 5, a bottom elevational view of the encased spring assembly 18 according to the present invention is shown. This particular figure is included to depict the thermal weld 44. Thermal weld 44 is a continuous weld applied to the bottom of the casing material 41 once the springs 30 are inserted into the pocket areas 40. The weld 44 is a product of heat applied to the casing 41 once the casing 41 is folded over upon itself thereby sealing and retaining springs 30 within the pocket area 40.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A cushion or mattress construction comprising:

a boxing structure having a bottom wall, top wall, and side walls defining a completely enclosed cavity wherein said walls are formed of foam material, said walls being permanently joined by an adhesive;

a plurality of coil springs wherein each spring has a profile with top and bottom coils of the spring being larger in diameter than the remaining coils of said spring, said springs having ends pointed inwardly of the spring;

a pliable casing material having said springs encased therein, said casing material having a plurality of pockets each of which has one of said springs therein to form an encased spring assembly, each of said springs being compressed to a predetermined height by said casing material said casing including pairs of vertical, thermally welded seams defining a cutting strip between adjacent pockets; and said encased spring assembly being arranged in serpentine fashion within said cavity and joined by an adhesive to an upper and lower surface of said cavity thereby filling said cavity with an array of springs defined by the serpentine positioning of the casing containing said springs.

2. The cushion of claim 1 wherein said casing material is folded over upon itself to form said pockets.

3. The cushion of claim 1 including down situated between said boxing structure and said cover.

4. The cushion of claim 1 including a resilient fiber layer situated between said boxing structure and said cover.

5. The cushion or mattress of claim 1 including foam insulation pads sized to fit said cavity, said pads disposed within said cavity and adjacent the top and bottom of said casing assembly and including adhesive between said insulation pads and said casing assembly.

6. The cushion or mattress of claim 5 wherein said pliable casing material is thermally weldable to itself.

7. The cushion or mattress of claim 5 wherein said pliable casing material is sewn to itself to form said pockets.

8. The cushion or mattress of claim 1 additionally comprising a containment cover shaped to conform to said boxing structure and adapted to receive and entirely enclose the same.

* * * * *